US007322476B2

(12) United States Patent
Witherspoon

(10) Patent No.: US 7,322,476 B2
(45) **Date of Patent: *Jan. 29, 2008**

(54) GAME BALL BAG

(75) Inventor: Frank Witherspoon, Covina, CA (US)

(73) Assignee: Frank Witherspoon, Jr., Corona, CA (US)

( * ) Notice: Subject to any disclaimer, the term of this patent is extended or adjusted under 35 U.S.C. 154(b) by 29 days.

This patent is subject to a terminal disclaimer.

(21) Appl. No.: 11/105,111

(22) Filed: Apr. 13, 2005

(65) Prior Publication Data

US 2005/0230277 A1 Oct. 20, 2005

Related U.S. Application Data

(63) Continuation-in-part of application No. 10/160,964, filed on Jun. 1, 2002, now Pat. No. 7,007,804.

(51) Int. Cl.
*B65D 85/00* (2006.01)

(52) U.S. Cl. ..... 206/579; 206/1.5; 206/315.9; 206/807; 70/64; 224/919

(58) Field of Classification Search ..... 206/1.5, 206/315.1, 315.9, 579, 807; 70/63–68; 224/919
See application file for complete search history.

(56) References Cited

U.S. PATENT DOCUMENTS

| | | | | | |
|---|---|---|---|---|---|
| 1,717,587 | A | * | 6/1929 | Shipley | 206/315.9 |
| 3,281,883 | A | * | 11/1966 | Glantz | 206/315.9 |
| 4,508,294 | A | * | 4/1985 | Lorch | 244/122 AG |
| 4,659,079 | A | * | 4/1987 | Blanchard | 206/315.9 |
| 4,691,824 | A | * | 9/1987 | Schindler | 206/315.9 |
| 5,238,162 | A | * | 8/1993 | LaCivita | 206/315.9 |
| 5,839,577 | A | * | 11/1998 | Friedler | 206/315.1 |

* cited by examiner

*Primary Examiner*—Luan K Bui

(57) ABSTRACT

A game ball bag having a ball bag portion including a zippered access opening that can be locked and secured to a fixture and having a cavity sized and adapted to receive and hold a ball, including a water bottle pocket with a sealable closure on one side thereof and a second outside pocket with a sealable closure for holding various items; and an interior pocket within the cavity for holding small items which warrant extra protection from theft.

19 Claims, 3 Drawing Sheets

GAME BALL BAG

CROSS-REFERENCES TO RELATED APPLICATIONS

This is a Continuation-In-Part of application Ser. No. 10/160,964 filed Jun. 1, 2002, U.S. Pat. No. 7,007,804, with a petition to revive. The prior application is hereby incorporated herein by reference as though fully set forth herein.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates generally to bags

2. Description of the Related Art

The closest prior art of which the applicant is aware is disclosed in U.S. Pat. No. 6,612,946 to McClain, filed on Nov. 8, 2002, entitled "Game ball anti-theft device." That device consists of a spherical web comprised of a plurality of cables, including three fixed lateral rings disposed in a spaced relationship. The plurality of cables also includes two openable longitudinal rings, each with opposed free ends that have hoops disposed thereon and alignable in a closed orientation for receiving a padlock. However, this device does not completely encase the ball nor does it provide a pocket for carrying a water bottle, or other secure pockets for holding valuables such as a cell phone or wallet which warrant extra protection from theft.

Therefore, there is a need for an improved device to protect a game ball and prevent it and accompanying items from being removed from a public area, in particular a game ball bag with a compartment specifically adapted for holding a large round object and including a locking strap for securing the bag in a locked configuration to an nonremovable structure such as a park bench, chain link fence, tree, or the like.

BRIEF SUMMARY OF THE INVENTION

In accordance with one aspect of the present invention, there is provided a game ball bag that includes a ball bag portion having a cavity sized and adapted to receive and hold a ball such as a basketball, soccer ball, or the like; the ball bag portion including a zippered access opening having a lockable zipper tab in combination with a lockable strap element that attaches to a latch extending from the closed zipper tab location in a manner such that the bag may be locked to a pole or the like by looping the strap around the pole and engaging the locking end of the strap with the latch and zipper tab closure; the exterior surface of the ball bag portion including a water bottle pocket with a sealable closure on one side thereof and a second outside pocket with a sealable closure for holding various items; if desired, an interior pocket may be provided for holding an item such as keys, a cell phone, a wallet, or other items which need extra protection from theft.

Further benefits and advantages of the present invention will become apparent after a careful reading of the detailed description of the invention and referring to the accompanying drawings.

DETAILED DESCRIPTION OF THE INVENTION

Figure 1:
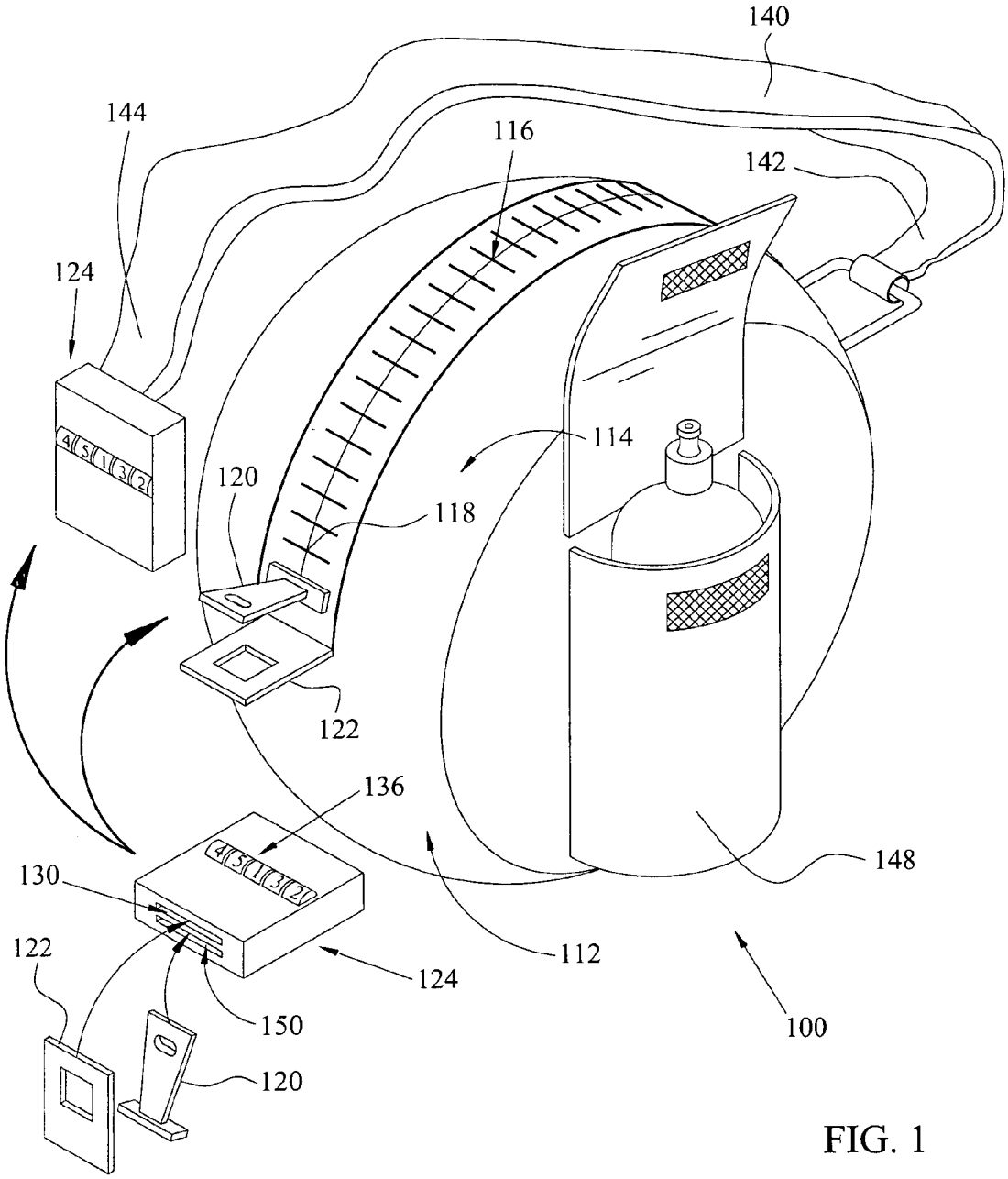
FIG. 1 is a side view of a first preferred embodiment of the present invention

Referring now to FIG. 1 there is shown a side view of a first preferred embodiment of the present invention.

In a first preferred embodiment of the present invention there is provided a game ball bag 100 comprising a ball bag portion 112 made of cut proof material, preferably Kevlar, shaped to form a cavity 114 that is adapted to hold a large round object such as a basketball, soccer ball, or the like and which is accessible through a zippered access opening 116 having a zipper 118 with a pull tab 120 that is positioned adjacent to a latch portion 122 of a combination locking mechanism 124 when the zipper 118 is in the closed position. Locking mechanism 124 includes a latch-receiving cavity 130 and a zipper pull tab receiving cavity 120 which are locked therein when the numerical combination dials 136 or the lock clasp 150 of locking mechanism 124 are moved from locked position.

Ball bag portion 112 also includes a strap 140 that is permanently secured to a first end 142 to bag portion 112 and is secured at the second end 144 to lock portion 124. An outside pocket 148 is provided on one side of the ball bag portion 112.

Figure 2:
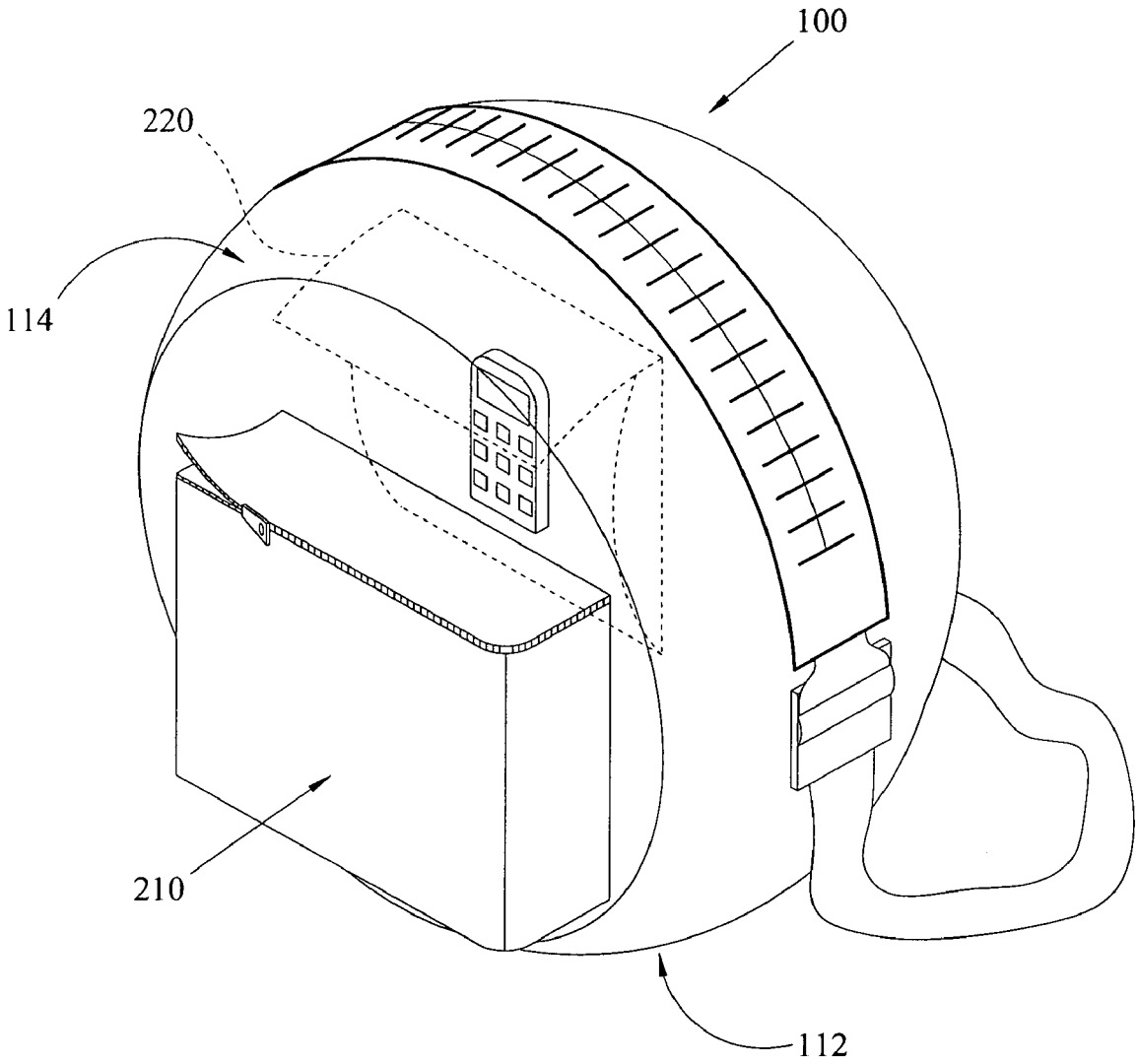
FIG. 2 is view of the of the opposite side of a first preferred embodiment of the present invention

Referring now to FIG. 2 there is shown the game ball bag 100 with zippered outside pocket 210 is provided on an opposite side of the ball bag portion 112, and an interior pocket 220 is provided within ball bag portion cavity 114.

Figure 3:
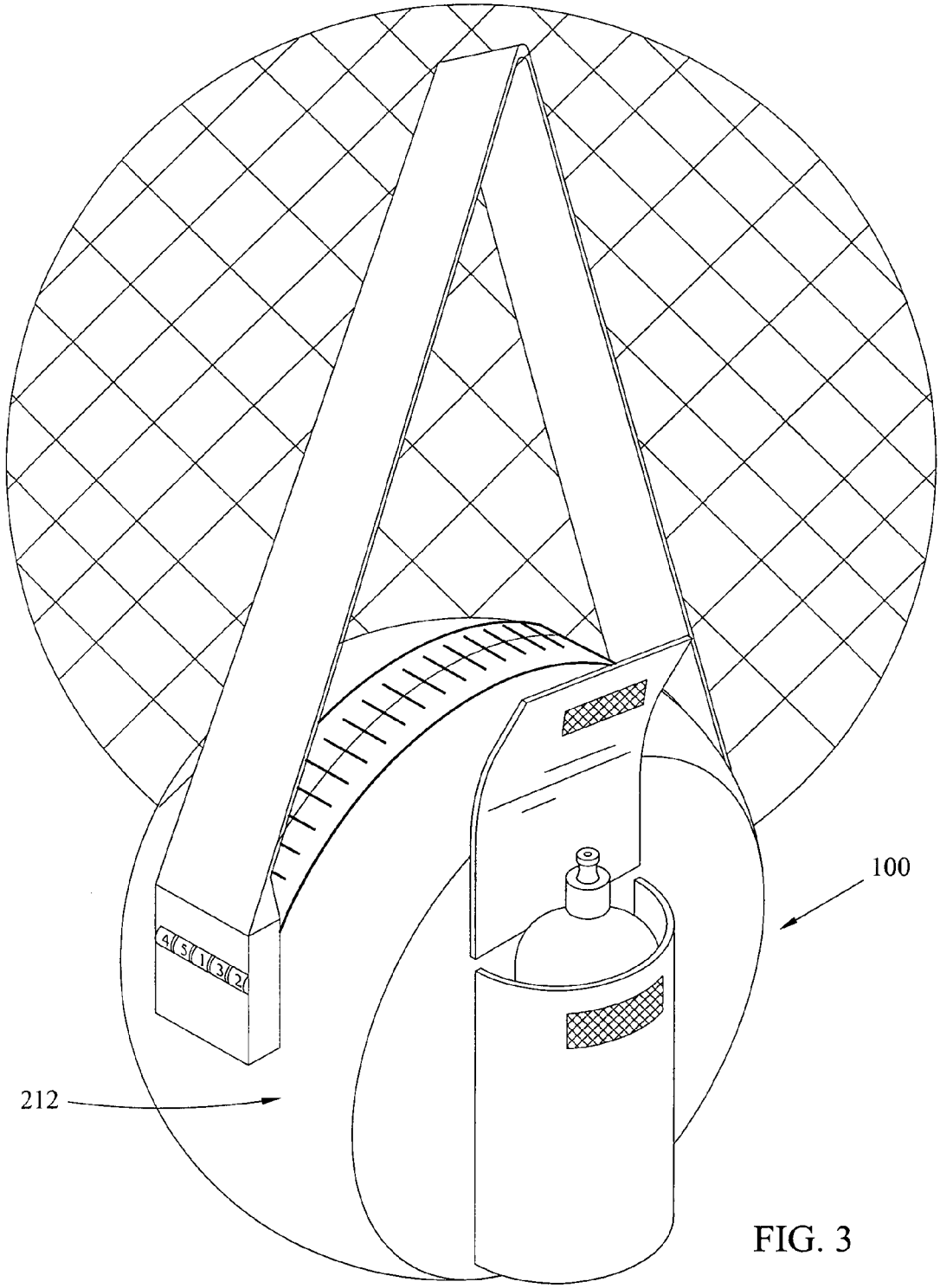
FIG. 3 is a cutaway view of the first preferred embodiment of the present invention.

Referring now to FIG. 3 it is seen that an outside pocket 148 is provided to hold a water bottle or other container for storing a drink. In a first preferred embodiment of the invention, outside pocket 148 is constructed of cloth. In another embodiment of the present invention, water bottle pocket 148 is composed of expandable mesh material, preferably nylon.

In another embodiment of the present invention, zippered outside pocket 250 is removable.

It is to be understood that the examples shown above are for illustrative purposes only, and that the particular materials and construction as well as other details are not to be construed in a manner that would limit the scope of the present invention.

What is claimed is:

1. A game ball bag comprising:

A ball bag portion having a cavity sized and adapted to receive and hold a ball;

the ball bag portion including a zippered access opening having a lockable zipper tab in combination with a lockable strap element that attaches to a latch extending from the closed zipper tab location in a manner such that the bag may be locked to a pole or the like by looping the strap around the pole and engaging the locking end of the strap with the latch and zipper tab closure;

the exterior surface of the ball bag portion including a water bottle pocket with a sealable closure on one side thereof and a second outside pocket with a sealable closure for holding various items; and an interior pocket within the cavity for holding small items which warrant extra protection from theft.

2. The game ball bag of claim 1, wherein the ball bag portion is constructed from a cut and puncture resistant material.

3. The game ball bag of claim 1, wherein, the ball bag portion is constructed of steel.

4. The game ball bag of claim 1, wherein the water bottle pocket is constructed of cloth.

5. The game ball bag of claim 1, wherein the water bottle pocket is constructed of expandable mesh fabric.

6. The game ball bag of claim 1, wherein the water bottle pocket is constructed of nylon mesh fabric.

7. The game ball bag of claim 1, wherein the outside pocket is removable.

8. The game ball bag of claim 1, wherein the outside pocket is constructed of mesh cloth fabric.

9. The game ball bag of claim 1, wherein the outside pocket is constructed of nylon mesh fabric.

10. The game ball bag of claim 1, wherein the outside pocket is constructed of fabric selected from the group consisting of cotton canvas, duck, and rubber.

11. The game ball bag of claim 1, wherein the bag includes a second trap to enable carrying it on one's back in a backpack-like fashion.

12. A game ball bag comprising:

A ball bag portion constructed of a cut or puncture resistant material having a cavity sized and adapted to receive and hold a ball;

the ball bag portion including a zippered access opening having a lockable zipper tab in combination with a lockable strap element that attaches to a latch extending from the closed zipper tab location in a manner such that the bag may be locked to a pole or the like by looping the strap around the pole and engaging the locking end of the strap with the latch and zipper tab closure;

the exterior surface of the ball bag portion including a water bottle pocket with a sealable closure on one side thereof and a second outside pocket with a sealable closure for holding various items; and an interior pocket within the cavity for holding small items which warrant extra protection from theft.

13. The game ball bag of claim 12, wherein the water bottle pocket is constructed of cloth.

14. The game ball bag of claim 12, wherein the water bottle is constructed of nylon mesh fabric.

15. The game ball bag of claim 12, wherein the outside pocket is removable.

16. The game ball bag of claim 12, wherein the outside pocket is constructed of cloth fabric.

17. The game ball bag of claim 12, wherein the outside pocket is constructed of mesh fabric.

18. The game ball bag of claim 12, wherein the outside pocket is constructed of fabric selected from the group consisting of cotton canvas, duck, and rubber.

19. The game ball bag of claim 12, wherein the bag includes a second strap to enable carrying it on one's back in a backpack-like fashion.

* * * * *